United States Patent [19]

Lane et al.

[11] Patent Number: 4,460,228

[45] Date of Patent: Jul. 17, 1984

[54] PITCH CHANGE CONNECTOR

[75] Inventors: David Lane, Greensboro; Ronald G. Sergeant, Winston-Salem, both of N.C.

[73] Assignee: AMP Incorporated, Harrisburg, Pa.

[21] Appl. No.: 433,930

[22] Filed: Oct. 12, 1982

[51] Int. Cl.[3] ..... H01R 13/39

[52] U.S. Cl. ..... 339/99 R

[58] Field of Search ..... 339/97 R, 97 P, 99 R, 339/276 SF

[56] References Cited

U.S. PATENT DOCUMENTS 3,918,789 11/1975 Davis ..... 339/245
4,190,952 3/1980 Thomas et al. ..... 339/99 R
4,241,970 12/1980 Rider, Jr. et al. ..... 339/99 R
4,315,664 2/1982 Hughes et al. ..... 339/97 R

FOREIGN PATENT DOCUMENTS 4780 10/1979 European Pat. Off. ..... 339/97 P

*Primary Examiner*—Joseph H. McGlynn
*Attorney, Agent, or Firm*—R. W. J. Usher

[57] ABSTRACT

An electrical connector having a series of terminals having contact portions located at different pitches at different faces of the connector. The terminals are formed from identical blanks and have looped body portions integrally joining the contact portions which body portions are deformable both laterally to accommodate the pitch-change and longitudinally to enable the contact portions to lie in coplanar places at respective faces.

10 Claims, 10 Drawing Figures

Fig. 1
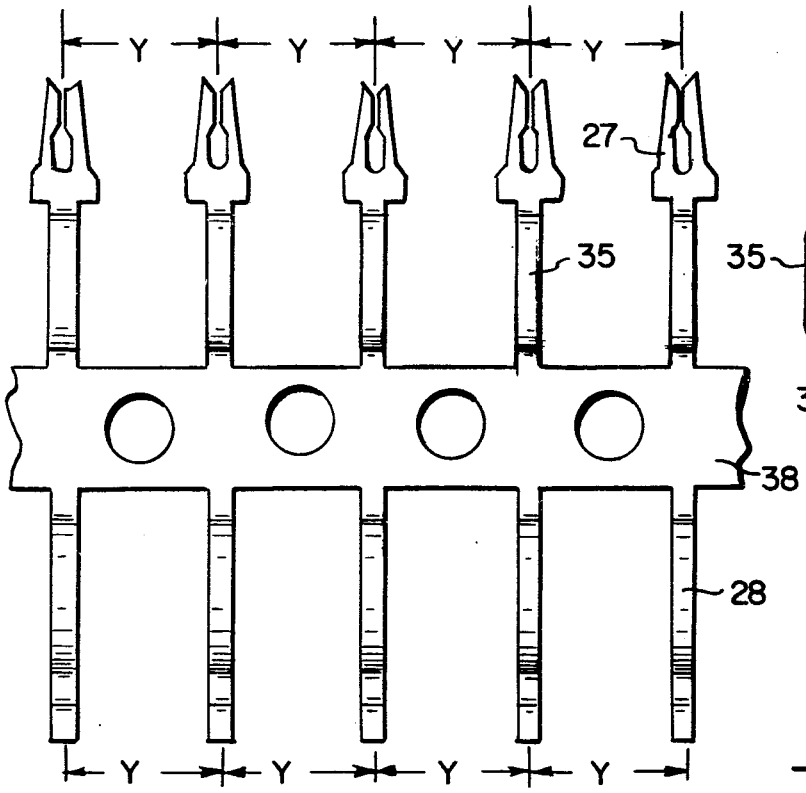
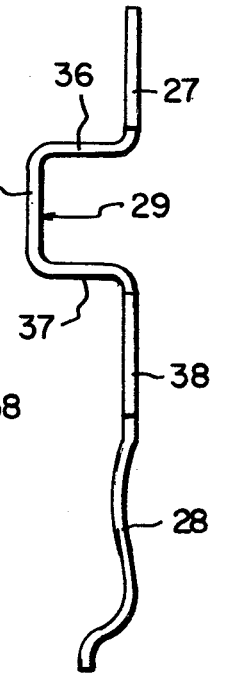
Fig. 2
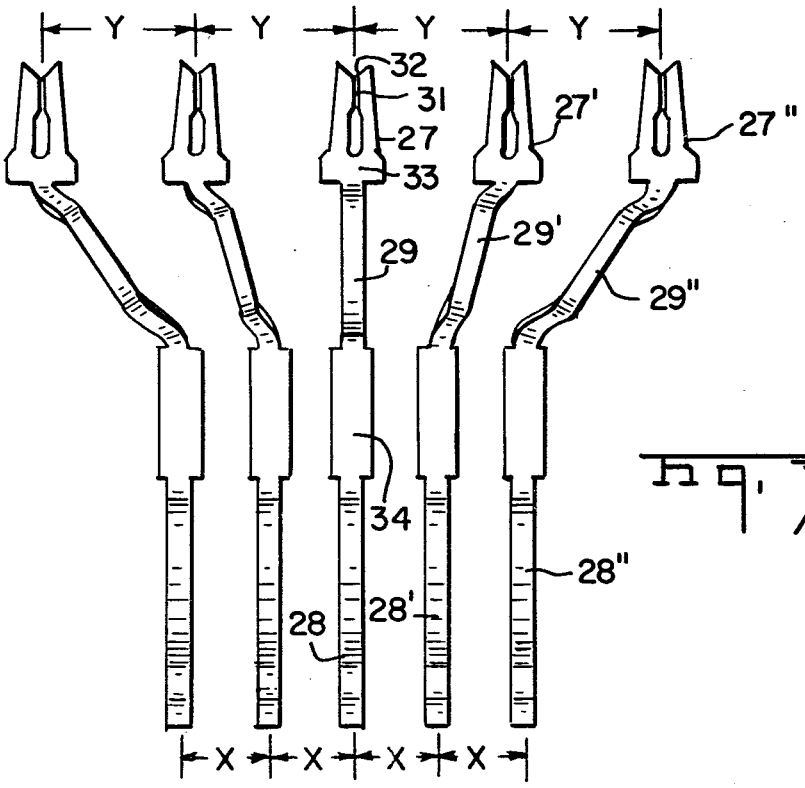
Fig. 3

PITCH CHANGE CONNECTOR

The invention relates to electrical connectors and particularly to electrical connectors which are adapted to interconnect a first and a second series of electrical elements arranged at different pitches.

There is often a requirement to interconnect two series of electrical elements arranged at different pitches; for example, a series of conductors of a ribbon cable arranged at one pitch and a series of pluggable elements arranged at a different pitch.

A common approach in the field is to use a connector with a first and a second series of contact portions at a common pitch and to alter the pitch of the individual conductors of the cable to the pitch of the contact portions by perforating the cable web and deforming the conductors. However, this procedure is time consuming and alignment difficulties may be experienced in maintaining the alignment of the conductors with the contact portions during connection.

In an attempt to avoid this time consuming procedure, a connector has been proposed in U.S. Pat. No. 3,990,767 in which identical individual terminals have deformable body portions integrally joining first and second contact portions. The relative lateral positions of the first and second contact portions can be altered by lateral deformation of the body portions. However, the body portions are not deformable longitudinally of the terminals; i.e. not extendable. In consequence, different degrees of lateral deformation to accommodate pitch change result in the individual first or second contact portions being disposed in different planes transversely of the terminal from other first or second contact portions, respectively resulting in either a requirement to deform the ribbon cable for termination or preventing mating with a conventional plug or socket connector.

It is an object of the invention to produce an electrical connector and terminal for connecting series of contact elements at different pitches by providing the terminals with body portions which are deformable both laterally and longitudinally of the terminals.

It is an additional object of the invention to provide terminals which can be stamped and formed from sheet metal as identical parts, but which can be used to enable interconnection between series of contact elements of and different pitch changes. This will enable the same die and terminal strip to be used to provide terminals which will interconnect series of contact elements at many different pitches.

An electrical connector according to the invention comprises an insulating housing having first and second faces, a series of terminals having been stamped from sheet metal stock as identical blanks and each comprising first and second contact portions integrally joined by a deformable strip-like body portion, the terminals being assembled with the housing with the first contact portions arranged at a first pitch at the first face, and the second contact portions arranged at a second pitch at the second face, the second pitch being different from the first pitch, the strip-like body portions having been deformed both longitudinally and laterally in their own planes to change the second contact portions from the first pitch to the second pitch.

Preferably, the terminals are assembled in the housing with the first contact portions located in coplanar relation at the first face and the second contact portions located in coplanar relation at the second face.

More specifically, the deformation of the bodies in the lateral direction is in the plane of the strip. The first and second contact portions are located in respective rows and the body portions comprise loops extending out of a plane containing the respective rows.

According to another aspect, the invention includes a series of identical stamped and formed terminals integrally joined to a carrier strip, each terminal comprising first and second contact portions extending in respective rectilinear rows and integrally joined by respective deformable body portions each comprising a loop extending out of a plane containing the respective rows.

Examples of the invention will now be described with reference to the accompanying drawings in which:

FIG. 1 is a plan view of a series of terminals integrally joined to a carrier strip with first and second contacts arranged at a first pitch;

FIG. 2 is a side elevation of a single terminal shown in FIG. 1;

FIG. 3 is a plan view of the series of terminals shown in FIG. 1 detached from the carrier strip and deformed to locate the first contact portions at a second pitch;

Figure 4:
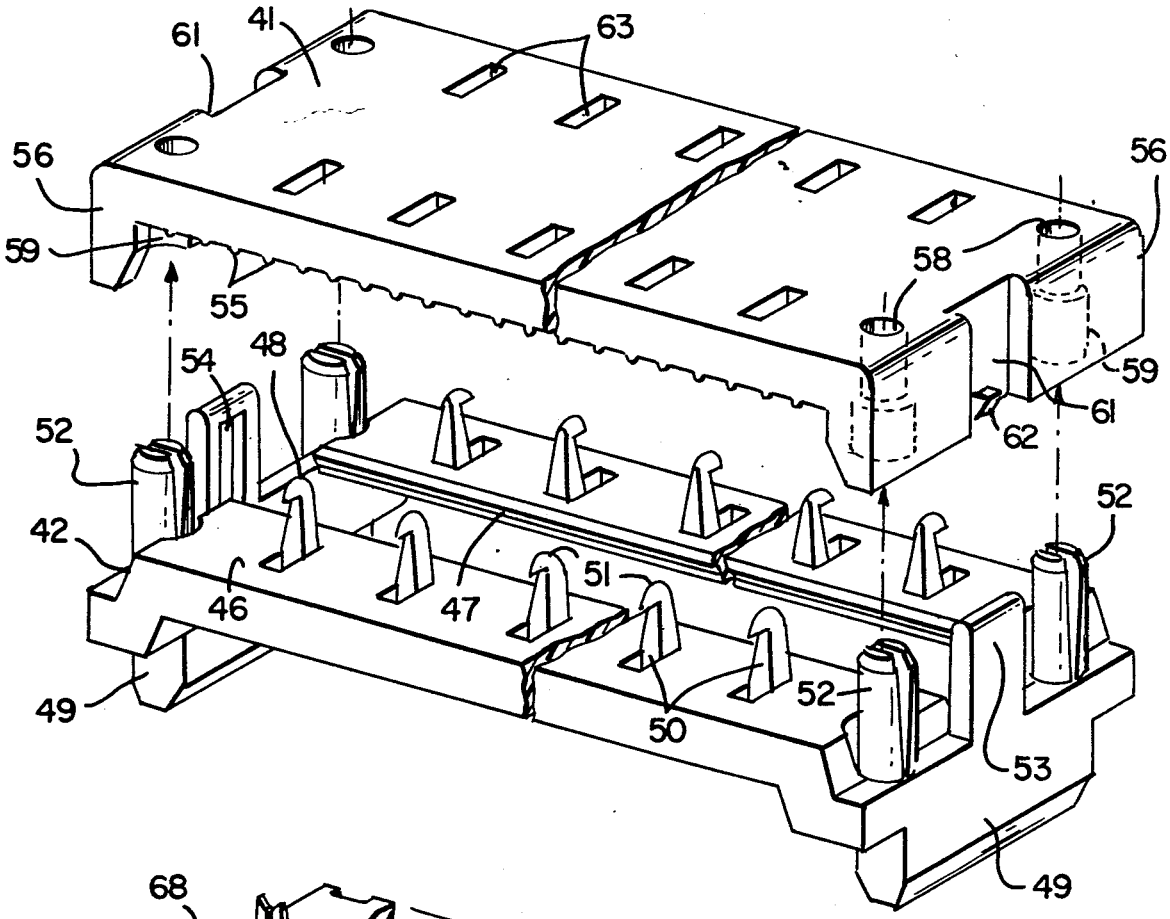
FIG. 4 is an exploded perspective view partly broken away of an electrical connector according to the invention.
Figure 4:
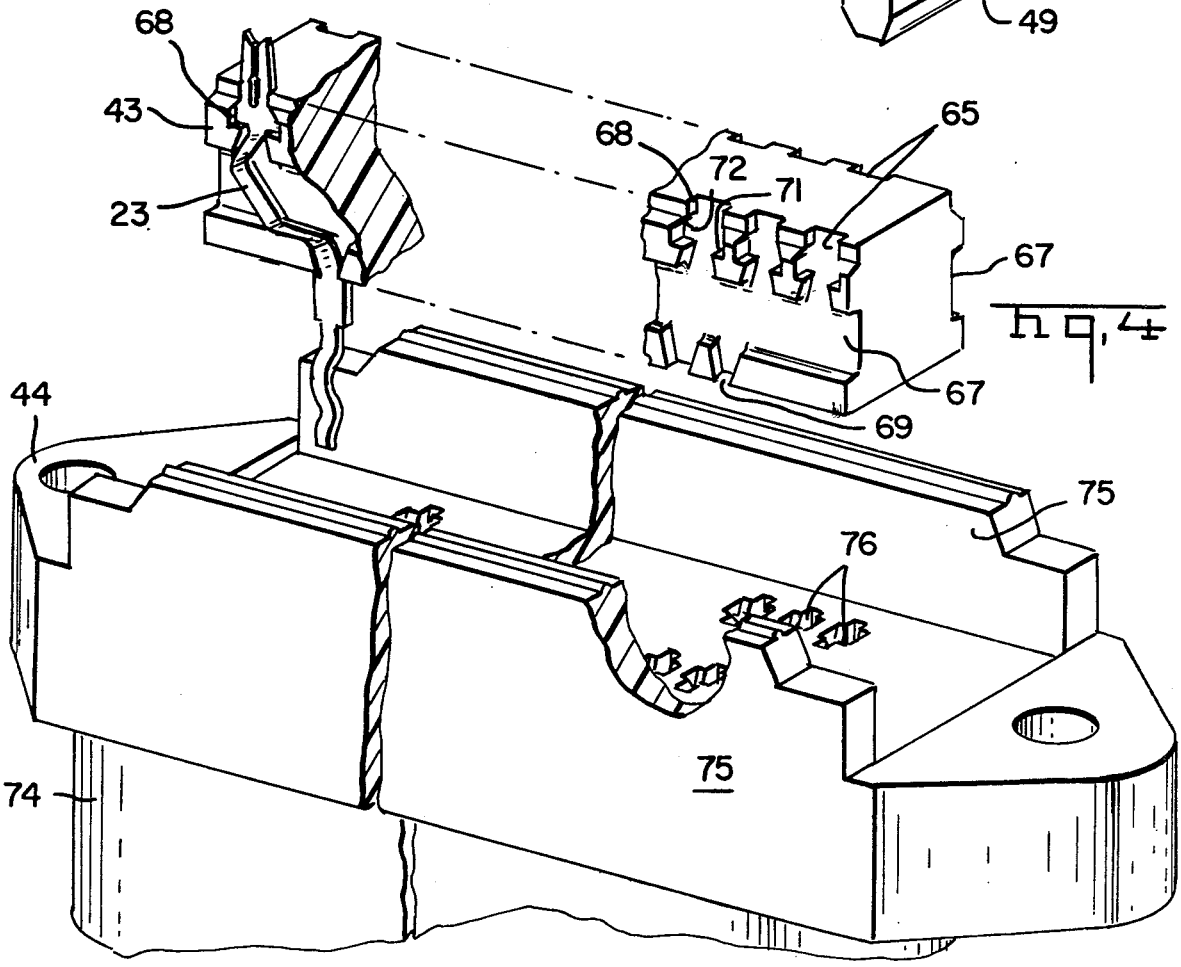
Figure 5:
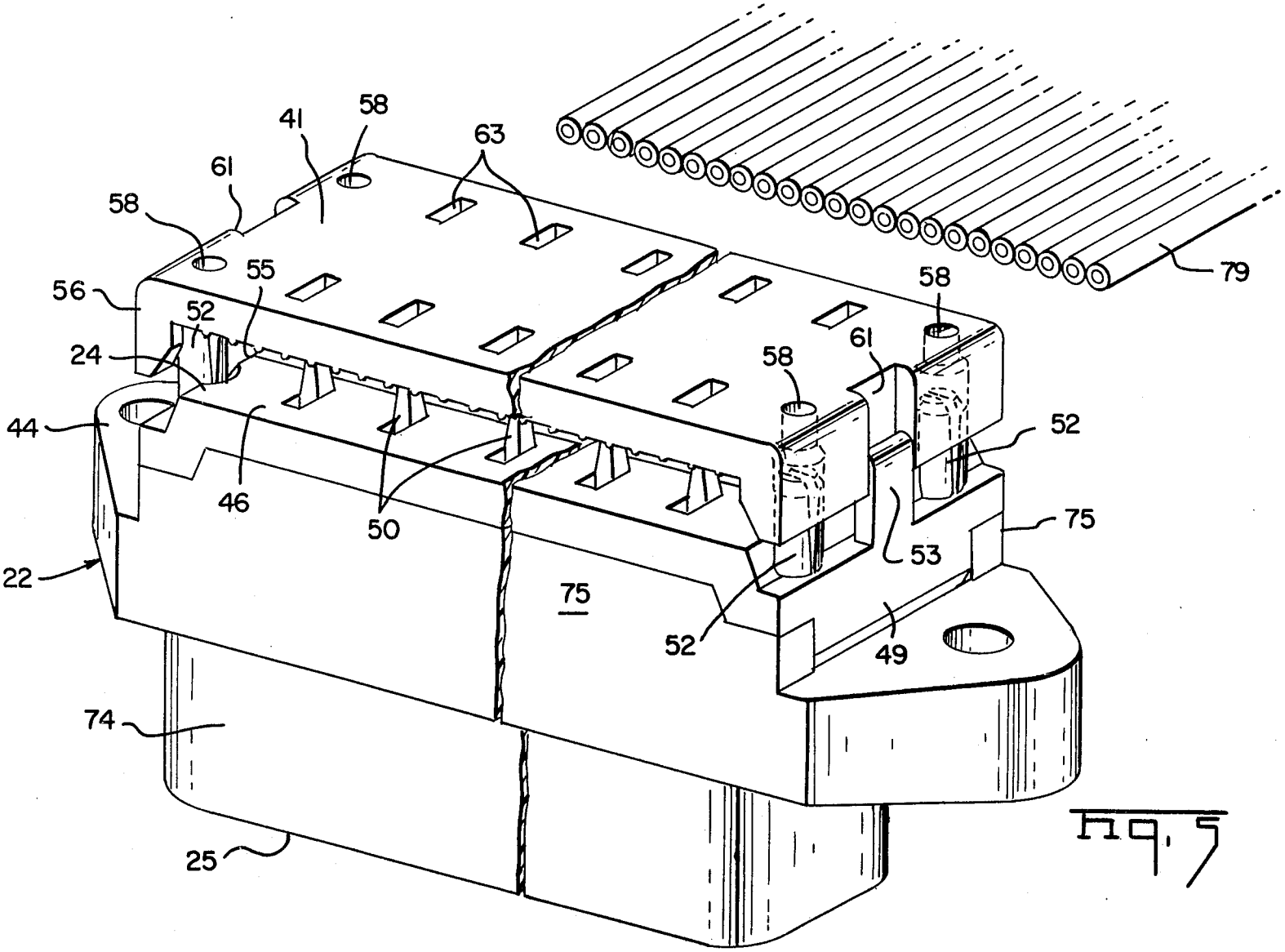
FIG. 5 is a perspective view of the electrical connector shown in FIG. 4 with a cover of the connector assembled with a body part of the connector in an open, cable-admitting position.
Figure 6:
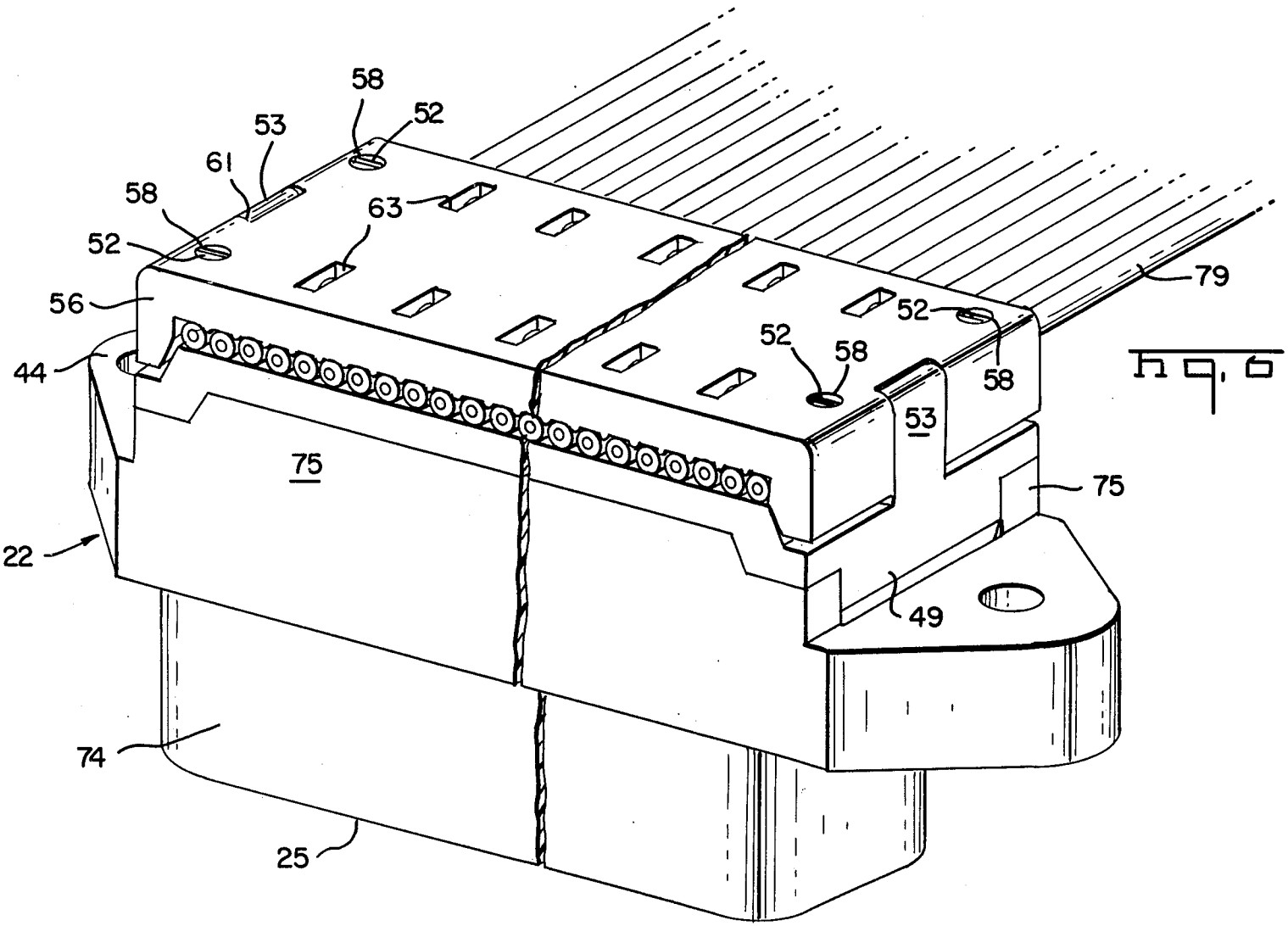
FIG. 6 is a view similar to FIG. 5 with the cover closed in a cable terminating position.
Figure 7:
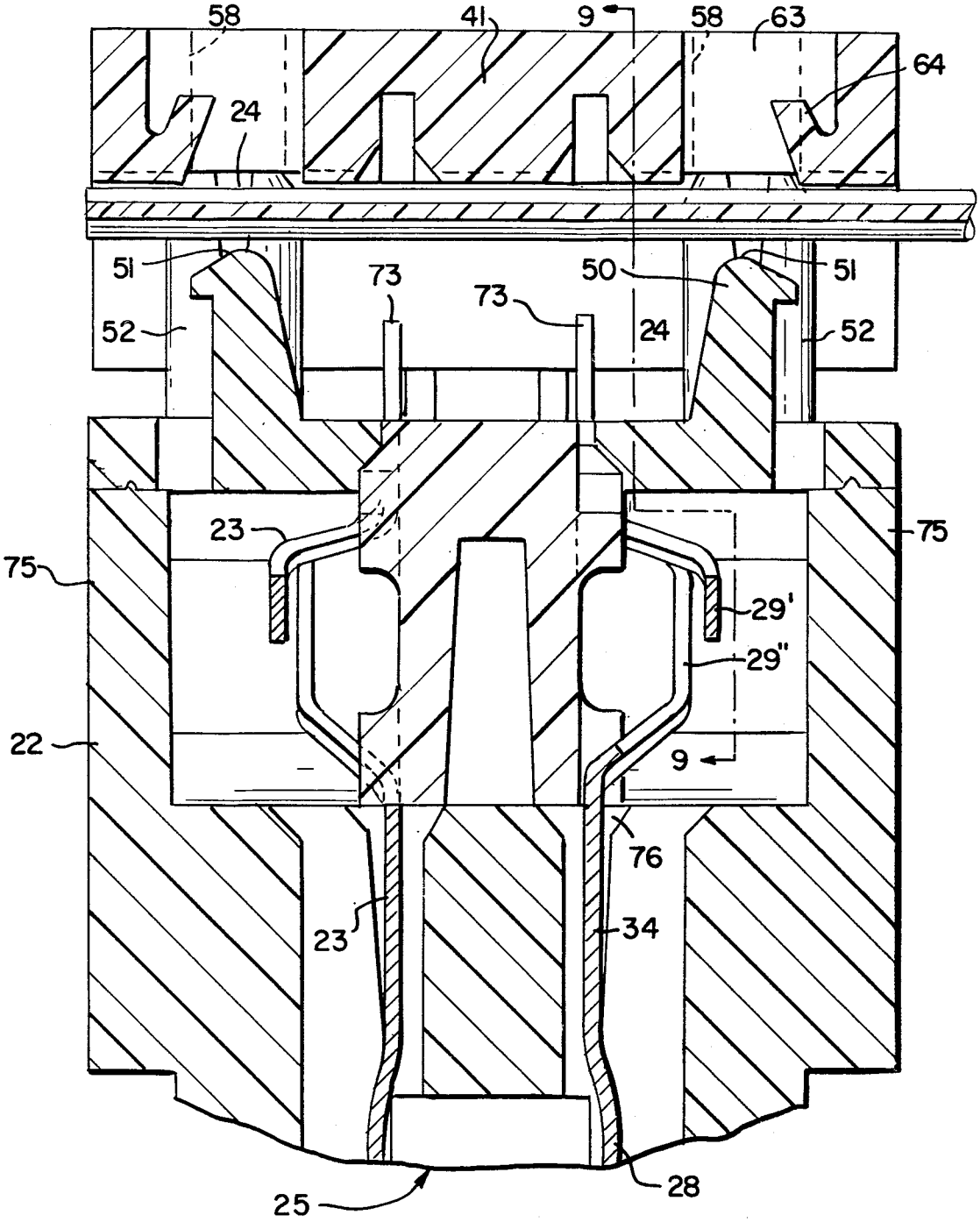
FIG. 7 is a cross-sectional view of the connector taken along line 7—7 of FIG. 9.

The electrical connector 21 comprises a housing 22 moulded from insulating plastics material and assembled with a series of terminals 23, each extending between a first, wire connecting face 24 and a second, contact face 25 of the housing. As shown particularly in FIGS. 1 to 3, the terminals are stamped (as identical blanks) and formed from sheet metal stock and comprise first and second longitudinally spaced contact portions 27 and 28, respectively integrally joined by a deformable portion 29. The first contact portions 27 have wire gripping slots 31 extending from pointed, cable penetrating ends and shouldered anchoring portions 33 at their junctions with root ends of the deformable portions. The second contact portions 28 are spring contact fingers bowed out of the plane of the stock. Shouldered anchoring portions 34 are also formed at the junctions of the contact portions 28 and the deformable portions 29. The deformable portions comprise loops bent out of the plane of the strip and comprising first and second upstanding arms 36 and 37 integrally joined together by a bridge 35. A carrier strip 38 integrally joins laterally adjacent anchoring portions 34.

As shown particularly in FIGS. 4 to 9, the housing 22 comprises a cable connecting part, including a pressure plate 41 and a cable supporting portion 42; a contact locating block 43 and a socket-form body 44.

The cable supporting portion 42 is moulded in one piece and comprises a platform 46 generally rectangular in plan and formed with an elongate aperture 48 defined between opposed longitudinally extending undercut edge portions 47. Feet 49, depend from respective opposite ends of the platform. Rows of hooks 50, each having insulation penetrating free ends 51 upstand from respective opposite sides of the platform and longitudinally split posts 52 upstand from respective corners of the platform 46. Guiding lugs 53 formed with blind-ended, guiding channels 54 upstand from the feet 49 adjacent each end of the aperture 48.

The pressure plate 41 is also generally rectangular in plan and a series of cable locating ribs 55 extend transversely across an under surface in parallel relation spaced apart by an amount equal to the pitch of the individual conductors of a ribbon cable.

Mounting flanges 56 depend from opposite ends of the pressure plate and post-receiving sockets 58 extend through the pressure plate at respective corners adjacent the flanges. The sockets diverge at the undersurface of the pressure plate and communicate with hemicylindrical mouths 59 extending through the flanges 58. Lug-receiving grooves 61 extend between lower, free and upper, root ends of the flange and stop-forming projections 62 are located in the grooves adjacent the lower ends of the flanges. Rows of hook-receiving sockets 63 extend through the pressure plate along respective opposite sides at the same spacing as the hooks 50. A latching detent 64 is located in each socket 63 for latching engagement with a hook 50 when the pressure plate has been pressed home on the cable supporting portion to a cable connecting position.

The contact locating block 43 is formed with first and second rows of cavities 65 and 66, respectively, extending along opposite longitudinal sides adjacent first and second faces. The cavities 65 on one side are staggered in relation to the cavities 64 on the other side. The first and second rows of cavities being spaced apart by a recess 67 extending along each side of the block and the cavities on one side being staggered in relation to cavities on the other side. Cavities 65 and 66 have divergent sidewalls 68 and 69, respectively communicating with the recess 67 while anchoring portion of cavities 65 have shoulders 71 at their junction with the divergent sidewalls and convergent sidewalls 72 communicating with the first face to conform with the profile of the anchoring portion 33.

The socket portion 44 includes a pair of sidewalls 75 upstanding in spaced apart relation from a terminal receiving face. A series of terminal receiving bores 76 extend between the terminal receiving face and a socket form contact face defined by a peripheral skirt 74 and terminal locating hooks 78 are provided at the remote extremity of the socket form contact face.

The connector is assembled by removing the individual terminals 23 from the carrier strip 38 and stitching them, contact fingers 28 leading into the respective bores 76. The pitch X of the bores 76 is equal to the pitch of the cavities 66 in the contact locating block but less than the pitch of the cavities 72 which, in turn, is equal (in a single row) to twice the pitch Y of the individual conductors of a ribbon cable 79. The contact locating block may then be urged between the two rows of terminals with the root ends of the deformable portions received snuggly in cavities 66. The strip like body portions 29', 29'' are then deformed both longitudinally and laterally in their own planes to various extents to enable the anchoring portions 33 to be seated in respective cavities 65 with the wire receiving contact portions in a single row at twice the pitch of the individual conductors of the cable. The divergent profile of the walls 68 and 69 accommodates the lateral deformation of the body portions. The first contact portions are located in coplanar relation at the first face and the second contact portions located in coplanar relation at the second face.

The cable supporting portion is then mounted on the socket portion with the feet 49 received between the side walls 75 and the undersurface seated snuggly against the free ends of the sidewalls 75. The wire connecting portions 27 of the terminals 23 will then protrude through the aperture 48 in the cable supporting portion and a shoulder 70 extending along the terminal locating block will seat against the undercut longitudinal edge of the aperture 48.

The terminal locating block may be ultrasonically welded or bonded to the socket portion.

The pressure plate 41 is then mounted on the cable supporting portion 41 in a cable receiving position (FIGS. 7 and 8) in which the free ends of the post 52 are received as an interference fit in hemicylindrical cavities 59 and the stop 62 is located at the upper extremity of guiding channel 54, the guiding lugs 53 being received as sliding fits in respective grooves 61. In this position, the hooks 50 are aligned with and spaced from the sockets 63.

Figure 8:
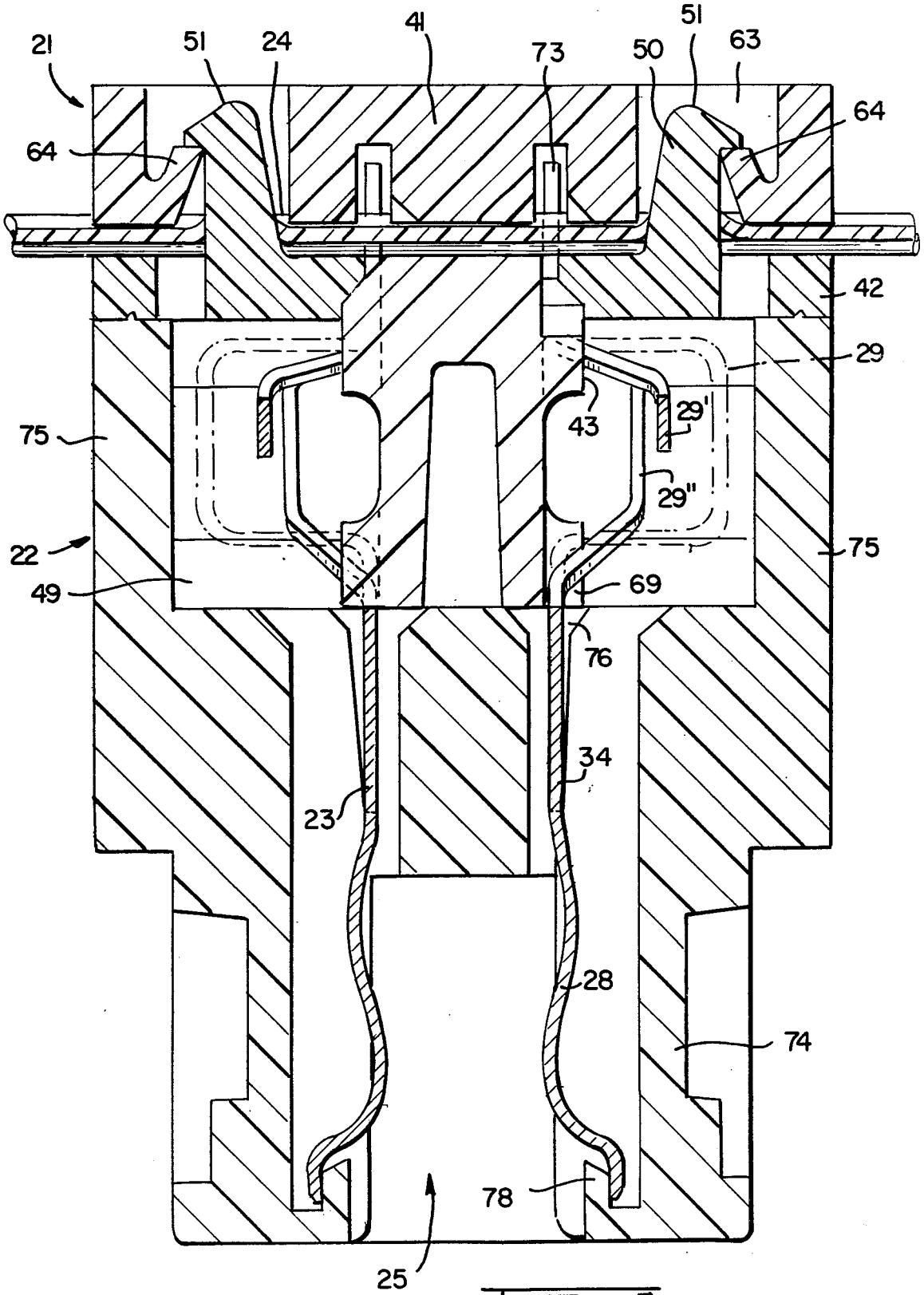
FIG. 8 is a similar view to FIG. 7 with the cover in the closed position.
Figure 9:
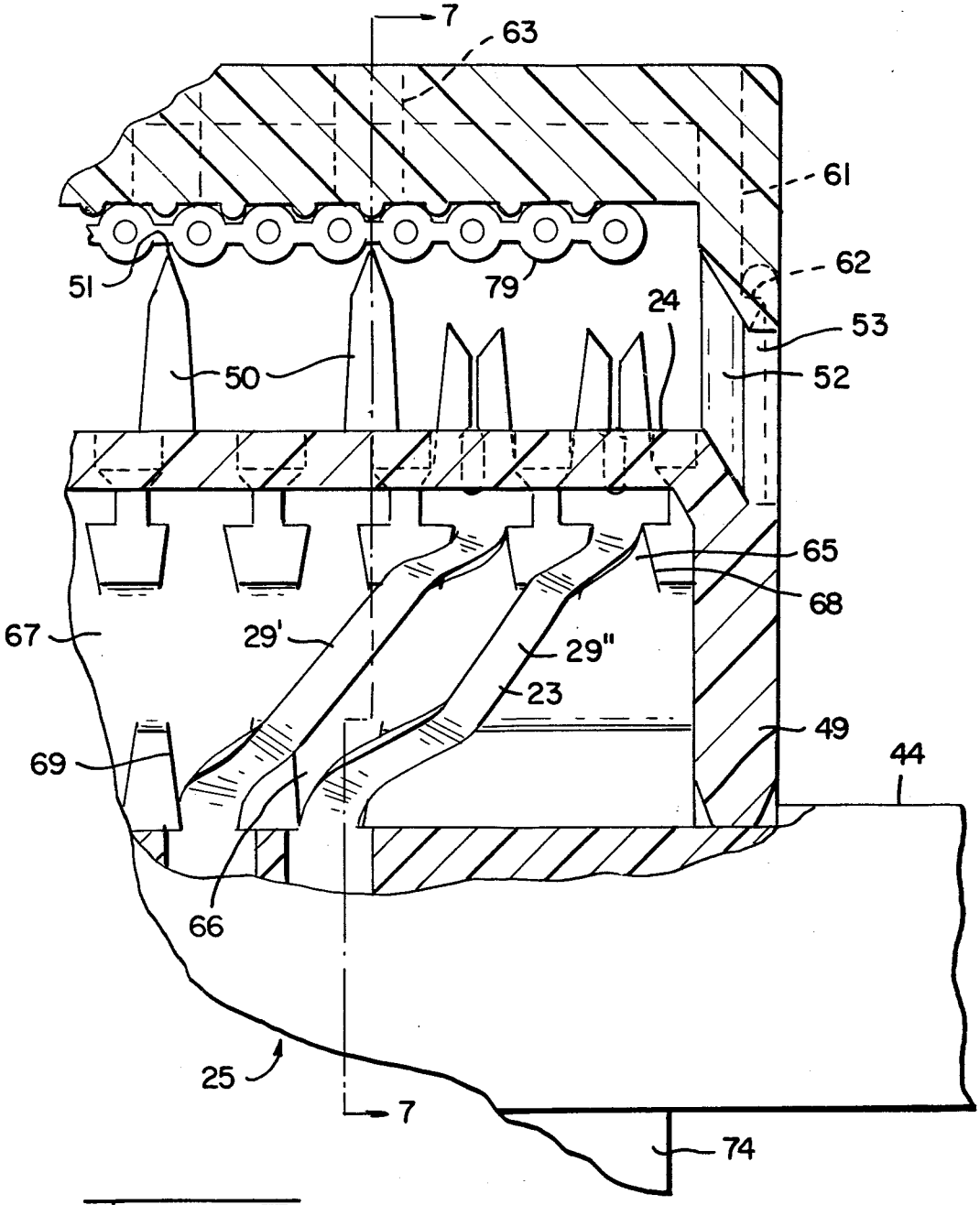
FIG. 9 is a cross-sectional view taken along line 9—9 of FIG. 7.
Figure 10:
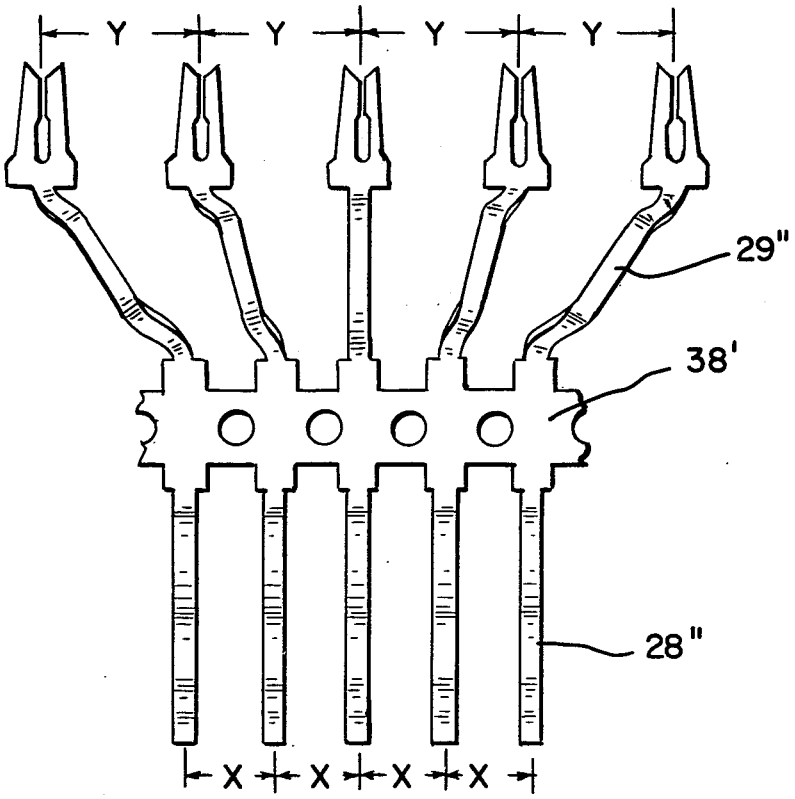
FIG. 10 is a fragmentary perspective view of an alternative series of terminals integrally joined to a carrier strip.

A ribbon cable is then inserted between the free ends of the hooks and the pressure plate and the pressure plate forced towards the cable supporting portion during the sharp ends of the hooks through the insulating web between adjacent conductors until the cable penetrating ends 32 of the wire connecting portions 27 of the terminals 23 also pierce the webs and the conductors are received in the slots 31. When the conductors are fully inserted in the slots, the hooks will catch the latching detents 64 as shown in FIG. 8 cable penetrating ends 32 of the terminals are received in the grooves 73 in the pressure plate and the free ends of the posts 52 are jammed into the sockets 58 ensuring that the pressure plate is retained firmly on the cable supporting portion. The pressure plate is guided during movement towards the cable supporting portion by the guiding lugs sliding along grooves 61 while the hooks assist in ensuring that the individual conductors of the cable are precisely aligned with the wire connecting portions of the terminals.

In an alternative method of assembling the terminals, the terminals are located in an undeformed condition on the strip 38' at the pitch X and, prior to severing individual terminals from the strip, the first contact or wire connecting portions have their pitch adjusted to pitch Y, double the spacing of the individual conductors of the ribbon cable, with consequential deformation of the body portion the individual terminals are then severed from the strip 38' and assembled with the connector.

In an alternative example of terminal, the bridge of the expandable body portion may be sinuous including three bights extending in a plane common to the remainder of the terminal. This will provide a more expandable body portion, but care should be taken not to make the radii of the bights too small in relation to the stock thickness to avoid a set being produced in the material.

We claim:

1. An electrical connector comprising an insulating housing having first and second faces, a series of terminals having been stamped from sheet metal stock as identical blanks and each comprising first and second contact portions integrally joined by a deformable strip-like body portion, the terminals being assembled with the housing with the first contact portions arranged at a first pitch at the first face, and the second contact portions arranged at a second pitch at the second face, the second pitch being different from the first pitch, the strip-like body portions having been deformed both longitudinally and laterally in their own planes to change the second contact portions from the first pitch to the second pitch.

2. An electrical connector according to claim 1 in which the terminals are assembled in the housing with the first contact portions located in coplanar relation at the first face and the second contact portions located in coplanar relation at the second face.

3. An electrical connector according to claim 2 in which the deformation of the bodies in the lateral direction is in the plane of the strip.

4. An electrical connector according to any one of claims 1 to 3 in which the first and second contact portions are located in respective rows and the body portions comprise loops extending out of a plane containing the respective rows.

5. An electrical connector according to claim 4 in which the first contact portions comprise plate portions provided with respective wire receiving slots, and the second contact portions comprise elongate pluggable elements, longitudinal axes of the pluggable elements extending parallel to longitudinal axes of the slots.

6. An electrical connector according to claim 4 in which a terminal locating block is formed with a first and a second row of cavities arranged at the first and the second pitches, respectively, adjacent the first and second faces, respectively, a first and a second root end of the loop of each terminal being located in corresponding cavities of the first and second row, respectively.

7. An electrical connector according to claim 6 in which each contact is provided with first and second anchoring portions adjacent the first and second root ends, respectively the anchoring portions being sized for receipt in respective cavities as a close fit.

8. An electrical connector according to claim 7 in which the terminal locating block is trapped between a cable connecting housing part and a mating housing part, the cable connecting part comprising a pressure plate mounted on a cable supporting portion and defining therewith a cable-receiving aperture, wire connecting portions of the terminals extending through an aperture located centrally of the cable supporting portion into the cable-receiving aperture, the cable supporting portion being integrally formed with a series of hooks aligned with latching apertures formed in the pressure plate in opposite sides of the aperture a series of posts split at free ends upstanding from the cable supporting portion in registration with a series of sockets in the pressure plate having relatively narrow portions and relatively broad portions, the pressure plate being movable towards the cable supporting portion from a cable-receiving position to a cable connection position, the free ends of the posts being receivable in the relatively broad portions of the sockets as an interference fit in the cable receiving position of the connector and in the relatively narrow portions as a force fit in the cable connecting position of the connector and free ends of the hooks penetrating the cable during such movement.

9. An electrical connector according to claim 8 in which guiding lugs and grooves are provided on the pressure plate and cable supporting surface, the grooves receiving the lugs in sliding engagement during the movement of the pressure plate from the cable receiving condition to the cable connecting condition.

10. An electrical connector according to claim 9 in which the grooves are blind ended and a stop is provided on the lugs to locate the pressure plate on the cable support.

* * * * *